US005939375A

United States Patent [19]

Müller et al.

[11] Patent Number: 5,939,375

[45] Date of Patent: Aug. 17, 1999

[54] LOW-VISCOSITY ALKALINE CLEANING EMULSION

[75] Inventors: Felix Müller, Velbert; Jörg Peggau, Essen, both of Germany

[73] Assignee: Th. Goldschmidt AG, Essen, Germany

[21] Appl. No.: 09/045,085

[22] Filed: Mar. 20, 1998

[30] Foreign Application Priority Data

Apr. 15, 1997 [DE] Germany ..... 197 15 599

[51] Int. Cl.[6] ..... C11D 1/83

[52] U.S. Cl. ..... 510/417; 510/218; 510/219; 510/423; 510/435; 510/436; 510/488; 510/437; 510/503

[58] Field of Search ..... 510/218, 417, 510/219, 423, 435, 436, 488, 437, 503

[56] References Cited

U.S. PATENT DOCUMENTS 4,438,024 3/1984 DelGreco et al. .

FOREIGN PATENT DOCUMENTS 0 314 232 5/1989 European Pat. Off. .

*Primary Examiner*—Margaret Einsmann
*Attorney, Agent, or Firm*—Scully, Scott, Murphy & Presser

[57] ABSTRACT

The invention relates to a low-viscosity alkaline cleaning emulsion comprising glyceryl trioleate or oleic acid, a nonionic emulsifier, an amine oxide, a hydrotrope, aqueous alkali metal hydroxide solution, a complexing agent and water, wherein the emulsifier is the reaction product of an ethoxylated glyceryl triricinoleate and oleic acid.

4 Claims, No Drawings

LOW-VISCOSITY ALKALINE CLEANING EMULSION

FIELD OF THE INVENTION

The present invention relates to a low-viscosity alkaline cleaning emulsion comprising from 1 to 25% by weight of glyceryl trioleate or oleic acid, from 1 to 10% by weight of a nonionic emulsifier, from 3 to 30% by weight of amine oxide, from 1 to 30% by weight of a hydrotrope, from 5 to 80% by weight of alkali metal hydroxide solution, from 1 to 10% by weight of a complexing agent and water.

BACKGROUND OF THE INVENTION

The cleaning of contaminated surfaces, in particular vertical, smooth surfaces in the meat and food processing industry, is relatively difficult. It is not always possible to ensure that the cleaning solution used has a sufficiently long contact time with the soiled surface in the time available. The cleaning solution runs off too quickly without the cleaning effect having been fully utilized.

It has therefore been attempted to clean, in particular, vertical walls using appropriate high-viscosity cleaning compositions. This contacting and the subsequent removal is, however, technically difficult to bring about and is very time consuming. Furthermore, relatively concentrated solutions are used. The use of polymeric thickeners in surfactant cleaning systems is also known. For example, EP-A-O-314 232 describes an alkaline cleaner having thickening properties following dilution to the working solution. To reduce the viscosity in the concentrate, the formulations are mixed with alcohols, such as ethanol or isopropanol, or other solvents which then lose their dilution effect in the working solution; as a result, the viscosity of the working solution to be applied to the surface is increased. The use of these solvents is associated with a considerable ignition and fire hazard because of their low flashpoints.

Furthermore, U.S. Pat. No. 4,438,024 discloses stable aqueous detergent compositions which comprise an amine oxide, a hydrotrope, oleic acid, a complexing agent, water and an alkali metal hydroxide solution for adjusting the pH. They are used in detergent preparations.

BRIEF SUMMARY OF THE INVENTION

The object of the invention is to provide a cleaning emulsion which does not have the disadvantages of the known cleaning compositions, and which has a sufficiently high viscosity in the working solution on the vertical surface to be cleaned to ensure an adequate contact time therewith.

The object is achieved by a low-viscosity alkaline cleaning emulsion wherein the emulsifier is the reaction product of an ethoxylated glyceryl triricinoleate and oleic acid. The invention comprises a low-viscosity alkaline cleaning emulsion comprising from 1 to 25% by weight of glyceryl trioleate or oleic acid, from 1 to 10% by weight of a nonionic emulsifier, from 3 to 30% by weight of amine oxide, from 1 to 30% by weight of a hydrotrope, from 5 to 80% by weight of alkali metal hydroxide, from 1 to 10% by weight of a complexing agent and water, wherein the emulsifier is the reaction product of an ethoxylated glyceryl triricinoleate with oleic acid.

DETAILED DESCRIPTION OF THE INVENTION

The alkali metal hydroxide is preferably sodium or potassium hydroxide and is preferably added as an aqueous solution thereof.

It is advantageous here to use an ethoxylated glyceryl triricinoleate which has been ethoxylated using from 10 to 30 mole equivalents of ethylene oxide. It has particularly advantageously been found that the use of a glyceryl triricinoleate which has been ethoxylated using from 15 to 25 mole equivalents gives very good results.

The preparation of the nonionic emulsifier according to the invention can be illustrated in more detail by the following diagram:

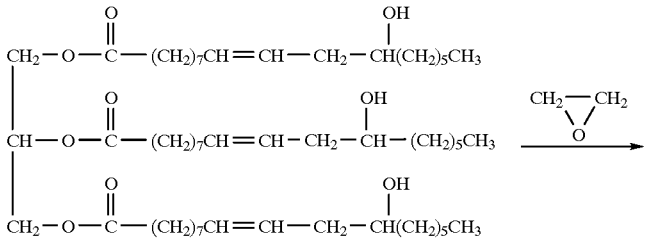

glyceryl triricinoleate (castor oil)

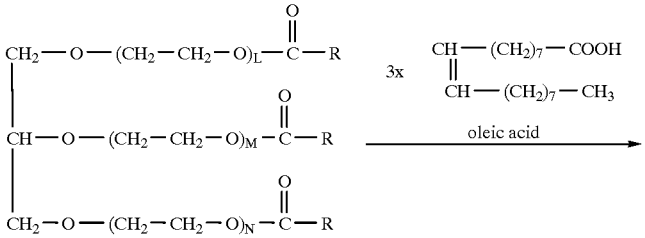

ethoxylated glycerol triricinoleate

-continued

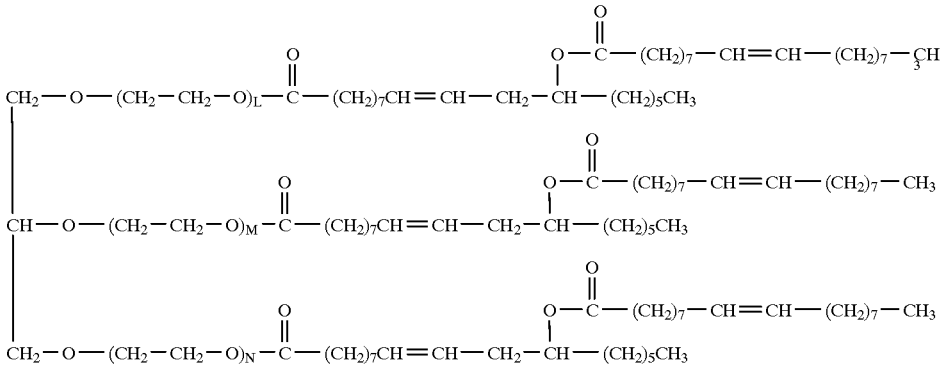

ethoxylated glyceryl trioleoricinoleate

Use of this highly effective emulsifier provides an initially low-viscosity cleaning emulsion, the viscosity of which increases sharply upon dilution with water to working solution (from 2 to 10%), enabling the emulsion to stay on the soiled, smooth, vertical surface for a sufficiently long time. The treated surface can then be rinsed quickly and easily. The cleaning emulsion is advantageously brought into contact with the surfaces to be cleaned using customary foaming equipment. As well as the viscosity increase, the increase in volume is also utilized. A foam produced using the cleaning emulsion according to the invention resembles honey in its behavior, so that the surface to be cleaned and wetted retains a continuous film of cleaner during the contact time.

It is a great advantage here that no solvents are used in the cleaning system according to the invention.

The amine oxides used are advantageously alkyldimethylamine oxides containing from 8 to 18 carbon atoms.

A particularly effective cleaning emulsion comprises from 3 to 12% by weight of glycerol trioleate or oleic acid, from 2 to 5% by weight of the reaction product of a glycerol triricinoleate which has been ethoxylated using from 15 to 25 mol equivalents of ethylene oxide, and oleic acid, from 3 to 25% by weight of sodium butyl monoglycol sulfate, from 5 to 30% by weight of alkali metal hydroxide (preferably sodium or potassium hydroxide, and preferably added as an aqueous solution thereof), from 2 to 6% by weight of the sodium salt of diethylenetriaminepenta (methylenephosphonic acid), and water as the remainder.

The cleaning emulsion is advantageously prepared by initially mixing the glycerol trioleate or the oleic acid with the emulsifier according to the invention (solution a). The other constituents are dissolved with vigorous stirring (phase b). Solution a is then incorporated into phase b with continuous stirring, and the mixture is stirred for a further 10 to 180 minutes until clear. Heating the mixture slightly to 40 to 80° C., particularly when using glyceryl trioleate, considerably shortens the time required to achieve a clear mixture.

A working solution is prepared using the following emulsion according to the invention:

| | | | |
|---|---|---|---|
| 1. | Glycerol trioleate | Olive Oil (food quality) | 4.0% |
| 2. | Emulsifier | Reaction product of a glyceryl triricinoleate, ethoxylated using 20 mol equivalents, and oleic acid | 2.0% |
| 3. | Amine oxide | Myristyldimethylamine oxide 30% | 16.0% |
| 4. | Hydrotrope | Sodium butyl monoglycol sulfate, 50% | 20.0% |
| 5. | Alkali metal hydroxide | Sodium hydroxide, 50% | 20.0% |
| 6. | Complexing agent | Sodium salt of diethylenetriaminepenta (methylenephosphonic acid), 32% | 4.0% |
| 7. | Water | | 34.0% |

The resulting solution has a viscosity of about 12 mPa·S. If the solution is diluted with water to the corresponding working solution, the viscosity increases sharply, and the solution has a viscosity of about 800 to 1200 mPa·s useful in cleaning a vertical surface. This means a considerable run-off delay compared with water and solutions of similar viscosity.

This behavior is illustrated in more detail by reference to the following example.

Various layer thicknesses were applied to a smooth glazed tile using a notched doctor blade, and the run-off behavior was examined. Layer thicknesses of 25, 50, 100, 150 and 200 μm were applied and their run-off behavior was observed. A system having the viscosity of water ran off immediately even at a layer thickness of 25 μm. At a concentration of >5% (viscoelastic concentration range) the alkaline cleaners examined had a continuous gel layer which did not run off even after 15 minutes at a layer thickness of 100 to 150 μm.

In the case of the 5% dilutions, which displayed viscous behavior, a continuous gel layer was observed after 15 minutes for 25 to 50 μm.

What is claimed is:

1. A low-viscosity alkaline cleaning emulsion comprising from 1 to 25% by weight of glyceryl trioleate or oleic acid, from 1 to 10% by weight of a nonionic emulsifier, from 3 to 30% by weight of amine oxide, from 1 to 30% by weight of a hydrotrope, from 5 to 80% by weight of an alkali metal hydroxide, from 1 to 10% by weight of a complexing agent and water, wherein the emulsifier is the reaction product of an ethoxylated glyceryl triricinoleate with oleic acid.

2. A cleaning emulsion as claimed in claim 1, wherein the glyceryl triricinoleate has been ethoxylated with from 10 to 30 mole equivalents of ethylene oxide.

3. A cleaning emulsion as claimed in claim 2, wherein the glyceryl triricinoleate has been ethoxylated with from 15 to 25 mole equivalents of ethylene oxide.

4. A cleaning emulsion as claimed in claim 1, comprising from 3 to 12% by weight of glycerol trioleate or oleic acid, from 2 to 5% by weight of the reaction product of oleic acid with a glycerol triricinoleate which has been ethoxylated with from 15 to 25 mole equivalents of ethylene oxide, from 3 to 25% by weight of myristyldimethylamine oxide, from 10 to 25% by weight of sodium butyl monoglycol sulfate, from 5 to 30% by weight of alkali metal hydroxide, from 2 to 6% by weight of the sodium salt of diethylenetriaminepenta(methylenephosphonic acid), and water as the remainder.

* * * * *